US006311361B1

(12) United States Patent
Cole

(10) Patent No.: US 6,311,361 B1
(45) **Date of Patent: *Nov. 6, 2001**

(54) HAND-SUPPORTED PIVOTING CLEANING DEVICE

(76) Inventor: Jeffrey H. Cole, P.O. Box 15803, Arlington, VA (US) 22215

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/347,190

(22) Filed: Jul. 2, 1999

(51) Int. Cl.[7] ..... A47L 13/10

(52) U.S. Cl. ..... 15/227; 15/143.1; 15/209.1; 15/244.1

(58) Field of Search ..... 15/143.1, 144.2, 15/172, 209.1, 220.1, 227, 228, 232, 244.1, 244.2

(56) References Cited

U.S. PATENT DOCUMENTS

| | | | | |
|---|---|---|---|---|
| 2,315,054 | | 3/1943 | Heber . | |
| 2,787,501 | | 4/1957 | Tuma . | |
| 3,568,237 | | 3/1971 | Rhodes . | |
| 3,760,450 | | 9/1973 | Griffin . | |
| 3,778,860 | | 12/1973 | Thielen . | |
| 4,945,599 | | 8/1990 | Flynn . | |
| 5,010,617 | * | 4/1991 | Nelson | 15/227 |
| 5,402,550 | * | 4/1995 | Lessard | 15/244.2 |
| 5,499,422 | * | 3/1996 | Lavazoli | 15/172 |
| 5,593,460 | * | 1/1997 | Lessard | 15/244.2 |
| 5,657,507 | * | 8/1997 | Wasak | 15/244.2 |
| 5,659,916 | * | 8/1997 | Beatty | 15/244.2 |
| 5,960,509 | * | 10/1999 | Wu | 15/244.2 |

FOREIGN PATENT DOCUMENTS

| | | | | |
|---|---|---|---|---|
| 0176157 | | 6/1935 | (CH) . | |
| 153474 | * | 7/1904 | (DE) | 15/143.1 |
| 0614552 | | 6/1935 | (DE) . | |
| 851677 | | 10/1952 | (DE) . | |
| 0413636 | | 7/1934 | (GB) . | |

* cited by examiner

*Primary Examiner*—Randall E. Chin
(74) *Attorney, Agent, or Firm*—Antonelli, Terry, Stout & Kraus, LLP

(57) ABSTRACT

A hand-supported pivoting cleaning device is provided so that a user can insert at least his/her fingers into a support element which is pivotally attached to a cleaning element in order to reach and clean awkwardly configured, and otherwise difficult-to-reach, surfaces.

9 Claims, 2 Drawing Sheets

HAND-SUPPORTED PIVOTING CLEANING DEVICE

BACKGROUND OF THE INVENTION

The present invention is a hand-supported pivoting cleaning device which enables a user to clean awkwardly configured surfaces or surfaces that are difficult to reach using conventional cleaning devices. Such surfaces include, but are certainly not limited to, windshield interiors and cylindrical surfaces.

Conventional cleaning devices include a sponge back washer described in U.S. Pat. No. 3,568,237 (Rhodes) by which an elongated handle is attached, via a hinge, to a rectangular base having a sponge attached thereto on the side opposite the hinge.

U.S. Pat. No. 3,760,450 (Griffin et al) describes a dust mop having an elongated handle pivotally attached to a dust mop carrier portion having an upper rigid portion and a lower cleaning portion.

U.S. Pat. No. 3,778,860 (Thielen) describes a mop frame assembly having an elongated handle pivotally attached to a mop via a universal joint including holding members and locking plugs.

However, none of the references described above relate to a cleaning device pivotally attached to a hand-supported guiding and directing portion to enable a user to direct the cleaning device into awkwardly-configured and tight-fitting spaces that are otherwise unreachable by conventional cleaning devices.

SUMMARY OF THE INVENTION

The present invention relates to a cleaning device which is pivotally attached to a hand-receiving and supported guiding and directing portion to enable a user to reach and clean surface areas that are awkwardly configured, tight-fitting and otherwise difficult or even impossible to reach and clean using conventional cleaning devices. In particular, the device enables a user to reach and clean such awkwardly configured surfaces by enabling a user to pivotally control a cleaning device using only an outstretched hand.

For example, cleaning the interior of an automobile windshield with a squeegee, sponge, etc. can be awkward due to the narrowing space between the dashboard of the automobile and the base of the windshield. Fitting a cleaning device in that confined space is difficult since conventional cleaning devices are usually hand-held, controlled by an elongated handle. The hand-held cleaning devices are unable to reach the bottom of the windshield interior or other such narrow spaces because the user's hand is made into a fist in order to hold the cleaning device, and therefore the user's fist which is holding the handle wedges between the windshield and the dashboard, thus not only blocking access to the bottom of the windshield but also soiling the windshield and dashboard with body oils as it is wedged there between. Further still, such cleaning devices which are controlled by an elongated handle prove to be difficult to maneuver due to the lack of leverage control.

Therefore, the present invention provides a hand-supported and guided cleaning device in which a cleaning device support plate detachably supports a cleaning device including, but is not limited to, a wiper, a squeegee, a sponge, a cloth and a chamois; and the cleaning device support plate is pivotally attached to a hand-receiving support portion, having an enclosure in which a user may insert his/her fingers or entire hand to thereby controllably direct the cleaning device into tight-fitting spaces that are otherwise inaccessible by conventional cleaning devices. Furthermore, by utilizing an extended hand in the hand-receiving and supporting guiding and direction portion which is adjacent to the pivoting attachment to the cleaning device, the user is able to exercise tremendous leverage control of the cleaning device in an awkwardly configured space.

DETAILED DESCRIPTION OF A PREFERRED EMBODIMENT

Figure 1:
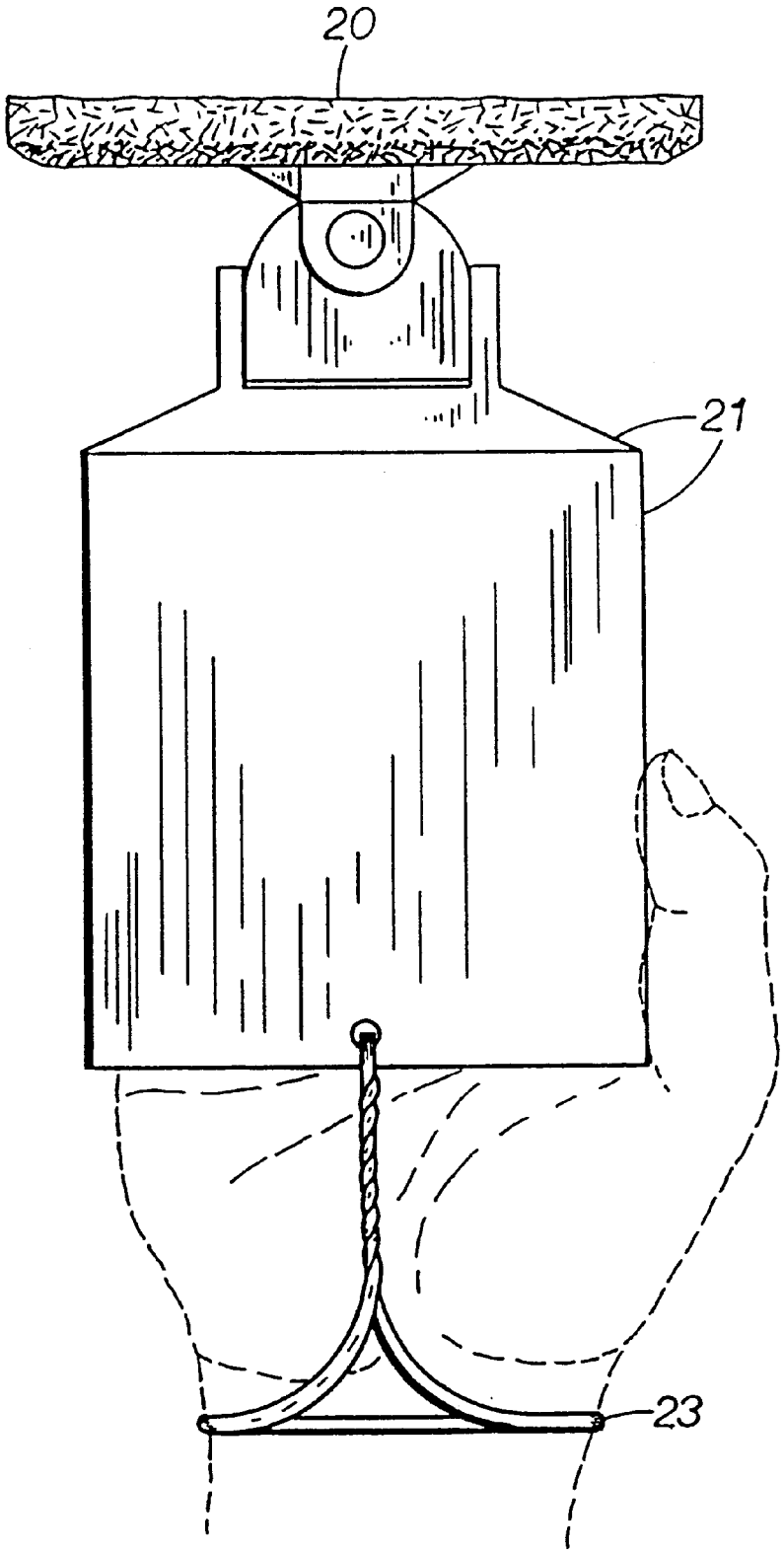
FIG. 1 is a frontal view of an embodiment of the present invention as held by a user thereof.
Figure 2:
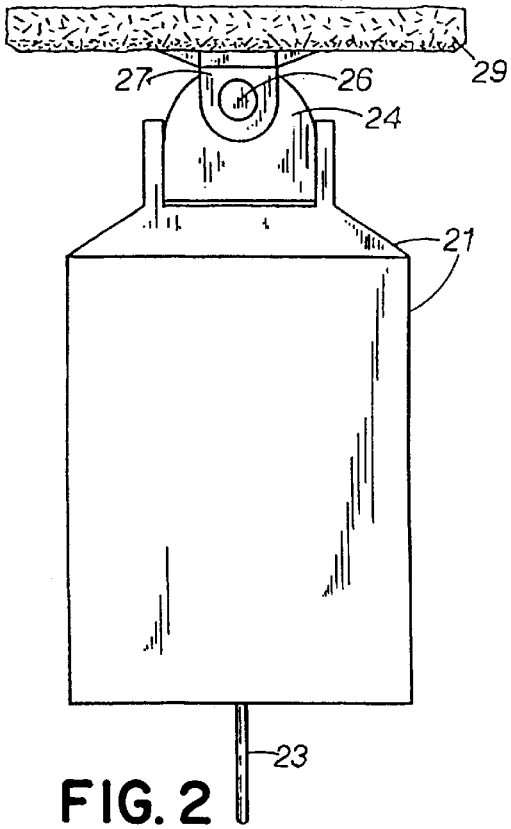
FIG. 2 is another frontal view of the embodiment of FIG. 1.
Figure 3:
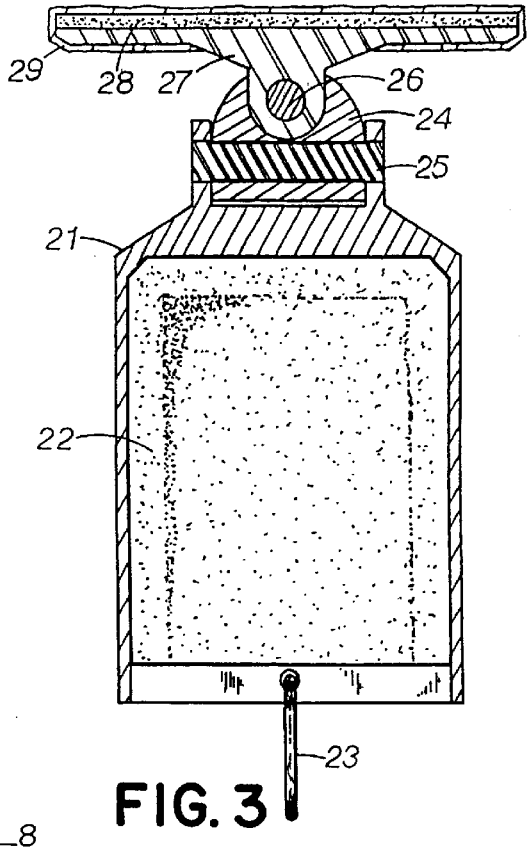
FIG. 3 is a rear view of the embodiment of FIG. 1.

FIG. 1 shows a frontal view of the present invention as held by a user of the hand-supported pivoting cleaning device 20. The features of the hand-supported pivoting cleaning device 20 are depicted in FIGS. 2 and 3, which shows the hand-supported pivoting cleaning device 20 as including a cleaning element base plate 27 which is a base portion to which a cleaning element 28 is attached. The cleaning element 28 can include, but is not limited to, at least one of a wiper, a squeegee, a sponge, a cloth or a chamois 29.

Figure 4:
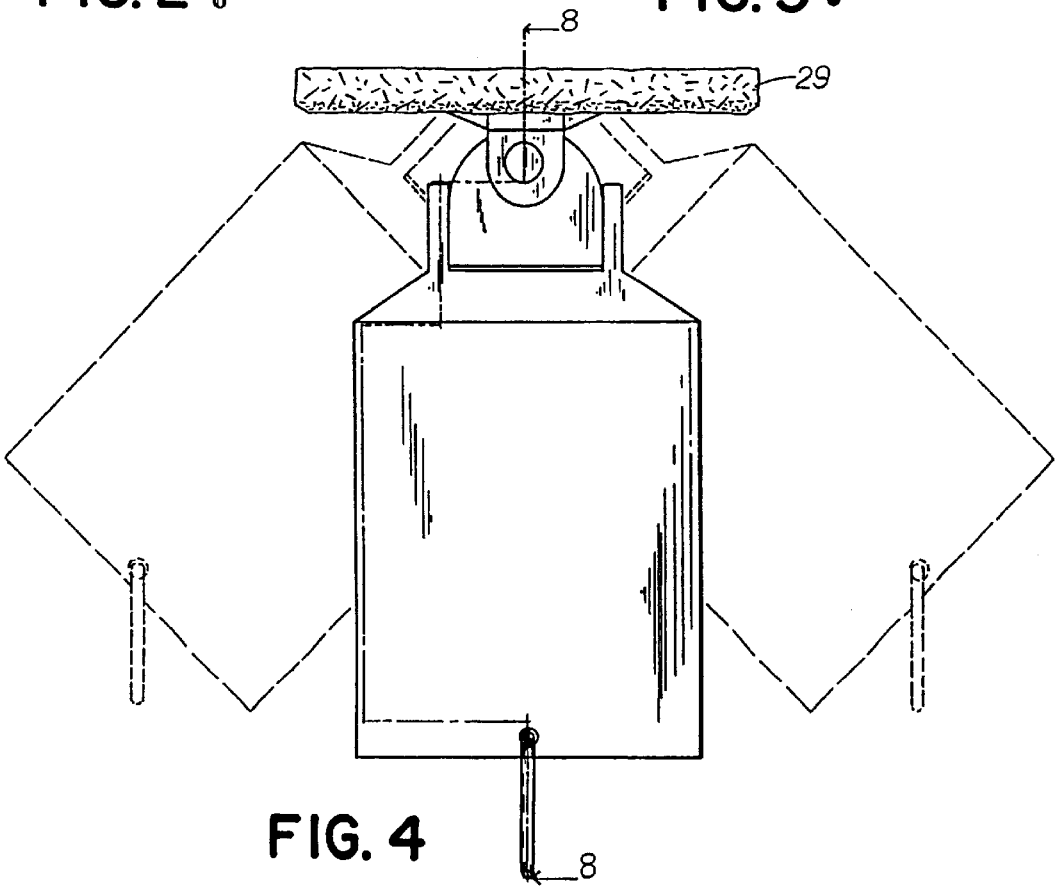
FIG. 4. is another frontal view of the embodiment of FIG. 1, further illustrating the maneuverability of the embodiment.

The cleaning element base plate 27 is pivotally attached to hand-supported receiving element 21 which is a base portion to which a hand-receiving portion 22 is attached. Pin 26 is inserted to pivotally attach the cleaning element base plate 27 to the pivot joint 24, and further serves as the axis for the cleaning element base plate 27 to pivot horizontally, relative to the hand-supported receiving element 21, as shown in FIG. 4. Pin 25 is inserted to pivotally attach the hand-supported receiving element 21 to the pivot joint 24, and further serves as the axis for the cleaning element base plate 27 to pivot vertically, relative to the hand-supported receiving element 21.

The hand-receiving portion 22 includes a material having a central opening therein thus being fashioned into a receiving pouch, so that a user can insert his/her fingers and/or entire hand into the hand-receiving portion 22. When a user of the device inserts his/her fingers and/or hand into the receiving pouch of the hand-receiving portion 22, the user's fingers and/or hand is enclosed in the receiving pouch in a manner such that the user's fingers are extended fully away from the palm, so that the remaining portion of the hand-supported receiving element 21 and the attached hand-receiving portion 22 are resting against the user's palm. It is beneficial for the cleaning of the surface to cover both sides of the hand-support receiving element with a non-stick, cleaning material to avoid body oils and other soiling elements from passing from the user's palm onto the surface being cleaned.

Furthermore, a wrist attachment 23 is secured to a distal end of the hand-supported receiving element 21, opposite thereto of the cleaning element base plate 27, and is tied around the user's wrist to help secure the user's hand to the hand-supported pivoting cleaning device 20, since the device 20 is subjected to multi-directional forces by the user.

Thus, the user places the cleaning element 28 attached to the cleaning element base plate 27 against a surface to be cleaned, and applies forces in all directions, forward, backward and laterally, in accordance with the movements of the user's hands, thereby cleaning the surfaces that conventional cleaning devices are unable to reach. The user's hands are kept in the hand-receiving portion 22 by the wrist attachment 23 since the user's palm is opened during use of the device 20, and therefore the user unable to actually grip the device 20. That is, the wrist attachment 23 is utilized to prevent displacement of the cleaning device 20 from the user's hands. The wrist attachment can include a string, but of course is not so limited.

Accordingly, the present invention is a device which enables a user to clean awkwardly configured or difficult-to-reach surfaces by enabling a user to pivotally control a cleaning devices with an outstretched hand.

Although the present invention was described above in accordance with a preferred embodiment, it is not limited thereto. Various modifications may be made without departing from the scope or spirit thereof, which are determined by the appended claims.

I claim:

1. A hand-supported pivoting cleaning device, comprising:

a hand-receiving support portion which receives a hand of a user and encloses at least fingers of said hand in a manner such that the fingers of said hand are fully extended away from the palm of said hand; and a cleaning portion pivotally attached to said hand-receiving support portion, wherein said cleaning portion is pivotally attached to a distal end of said hand-receiving support portion, and wherein said distal end of said hand-receiving support portion at which said cleaning portion is pivotally attached is located at a position on said hand-receiving support portion furthest away from an opening of said hand-receiving support portion, said opening receives at least the fingers of said hand.

2. A hand-supported pivoting cleaning device according to claim 1, wherein said cleaning portion is pivotally attached to said hand-receiving support portion by a pin.

3. A hand-supported pivoting cleaning device according to claim 1, wherein said cleaning portion is one of a group including a wiper, a squeegee, a sponge, a cloth and a chamois.

4. A hand-supported pivoting cleaning device according to claim 1, wherein said hand-receiving support portion is attached to a base support layer.

5. A hand-supported pivoting cleaning device according to claim 4, wherein said hand-receiving support portion includes a pocket for receiving a hand of the user of said device.

6. A hand-supported pivoting cleaning device according to claim 5, wherein said pocket is make of a non-sticking, cleaning material.

7. A hand-supported pivoting cleaning device according to claim 1, wherein said cleaning portion pivots in a horizontal and a vertical direction relative to said hand-receiving support portion.

8. A hand-supported pivoting cleaning device according to claim 1, wherein said cleaning portion is pivotally attached to said hand-receiving support portion by a first pin which allows said cleaning portion to pivot in a horizontal direction relative to hand-receiving support portion, and wherein said cleaning portion is further pivotally attached to said hand-receiving support portion by a second pin which allows said cleaning portion to pivot in a vertical direction relative to said hand-receiving support portion.

9. A hand-supported pivoting cleaning device according to claim 1, wherein a wrist attachment is attached to a further distal end of said hand-receiving support portion opposite to said distal end, said wrist attachment secures the hand of the user to the hand-supported pivoting cleaning device.

* * * * *